US005619217A

United States Patent [19]

Mailandt et al.

[11] Patent Number: 5,619,217

[45] Date of Patent: Apr. 8, 1997

[54] CELLULAR AND PCS ANTENNA MOUNTING ASSEMBLY

[75] Inventors: Peter Mailandt, Dallas; Ricardo Vazquez, Plano, both of Tex.

[73] Assignee: Allen Telecom Group, Inc., Dallas, Tex.

[21] Appl. No.: 444,959

[22] Filed: May 19, 1995

[51] Int. Cl.[6] ..... H01Q 1/42

[52] U.S. Cl. ..... 343/872; 343/878

[58] Field of Search ..... 343/872, 873, 343/878, 720, 906; H01Q 1/12, 1/20, 1/18, 1/40, 1/42

[56] References Cited

U.S. PATENT DOCUMENTS 3,781,894 12/1973 Ancona et al. ..... 343/872

4,006,480 2/1977 Charette et al. ..... 343/872

*Primary Examiner*—Michael C. Wimer

*Attorney, Agent, or Firm*—Laff, Whitesel, Conte & Saret, Ltd.

[57] ABSTRACT

An antenna assembly for cellular and PCS systems for mounting on a ceiling or wall surface of a building. The assembly includes a radome covering the antenna and a base, and a concealed mounting assembly including pins having snap retainers secured to the base and snap retainers secured to a bracket fixed to the wall or ceiling.

5 Claims, 3 Drawing Sheets

CELLULAR AND PCS ANTENNA MOUNTING ASSEMBLY

BACKGROUND OF THE INVENTION

With the advent of personal communications systems operating in the 800/900 MHz and the 1.7 to 2.0 gigahertz ranges which have been developed for outside use as well as for use internally of office and industrial buildings, the need for effective antennas distributed locally throughout such buildings has increased. Although the technology for such antennas exists and such antennas can be neatly and compactly packaged, the need for small and attractive packaging and easy flush mounting of such antennas on walls and ceilings remains.

Although antennas designed for in-building communication systems can generally be implemented as relatively compact packages, for a variety of reasons, including unencumbered propagation of radio frequencies and of signal propagation, antennas cannot usually be hidden from view above or inside ceilings or inside the walls. Instead, the antennas must be suspended from ceilings or walls where they may be easily seen, and where they are more susceptible to visual inspection and to damage than are hidden installations.

Some antenna designs are inherently fragile, and in order to minimize the possibility of damage a protective cover or radome is generally installed over the antenna. Little effort has been expended on aesthetically pleasing designs for such protective covers, nor has the issue of mounting an antenna assembly in an exposed yet unobtrusive manner been satisfactorily addressed.

In the past, installations much like those used for suspending ceiling fixtures have sometimes been used for antenna assemblies like those assemblies described above. In such instances an electrical box-like structure is mounted flush with a ceiling or wall, is wired with suitable RF cable, and the antenna assembly is attached with visible screws, for example. Installation of electrical boxes requires the use of special tools, are expensive and are cumbersome for low-power antenna systems.

It is therefore an object of the present invention to provide an improved flush mounting system for a PCS or like antenna assembly.

SUMMARY OF THE INVENTION

In accordance with the present invention an improved antenna assembly for mounting on an internal ceiling or wall surface of a building is provided. The antenna assembly comprises an antenna housing having a cover and a base plate, an RF antenna housed within a cavity defined by the cover and the base plate, and a connector for connecting the antenna to a transceiver. The base plate defines a plurality of openings. A bracket defining a plurality of openings is provided as are plurality of pins, each having a pair of ends. Each of the pin ends defines a plurality of snap retainers, engaging, at their respective ends, in the base plate openings and the bracket openings, whereby the bracket and base plate are fixed in relation to each other via the pins. In that manner the antenna assembly is securely and attractively flush mountable to the internal wall or ceiling of a building construction.

In a preferred form, each of the plurality of pins has a pair of ends, each of the ends defining a plurality of spaced elements and a stop. One of the pin ends is disposed in the base plate openings and the other of the pin ends is disposed in the bracket openings. At one end, the spaced elements of each of the pins defines an outer zone smaller than the size of the base plate openings, an intermediate zone larger than the size of the base plate openings, and an inner zone smaller than the intermediate zone, the stop being adjacent the inner zone, and the stop and the intermediate zone cooperating to retain the one end in the base plate opening in the inner zone. At the other ends of the pins, the spaced elements define an outer zone smaller than the size of the bracket openings, an intermediate zone larger than the size of the bracket openings, and an inner zone smaller than the intermediate zone, the stop being adjacent the inner zone, and the stop and the intermediate zone cooperating to retain the other end in the bracket opening in the inner zone.

In one form of the invention the bracket mounts a plurality of threaded studs adapted to extend through a ceiling or wall surface panel, and means for securing the antenna assembly to a panel are also provided. The securing means preferably comprises a second bracket defining holes in line with the threaded studs and receiving the studs, and a plurality of nuts for drawing the antenna assembly into secure, flush mounting engagement with the panel. Desirably the pin inner zones define camming surfaces to facilitate removal of the pin and elements from their associated openings.

Further objects, features and advantages of the present invention will become apparent from the following description and drawings.

DETAILED DESCRIPTION

Figure 1:
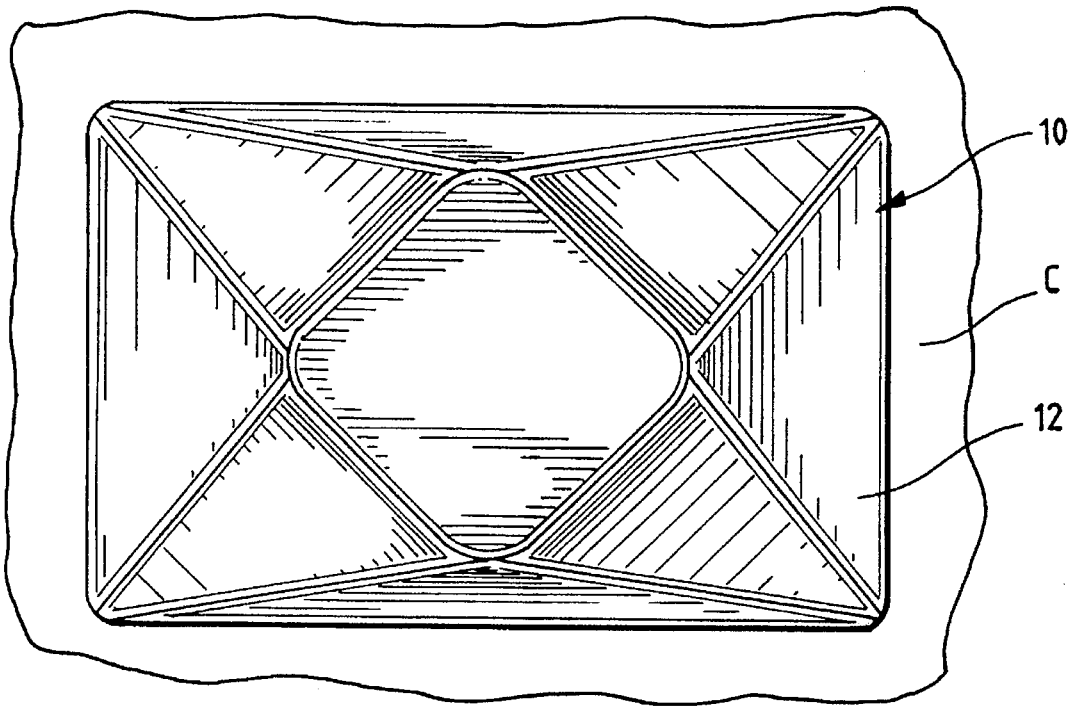
FIG. 1 is a plan view of an antenna assembly mounted to the ceiling of a building.
Figure 2:
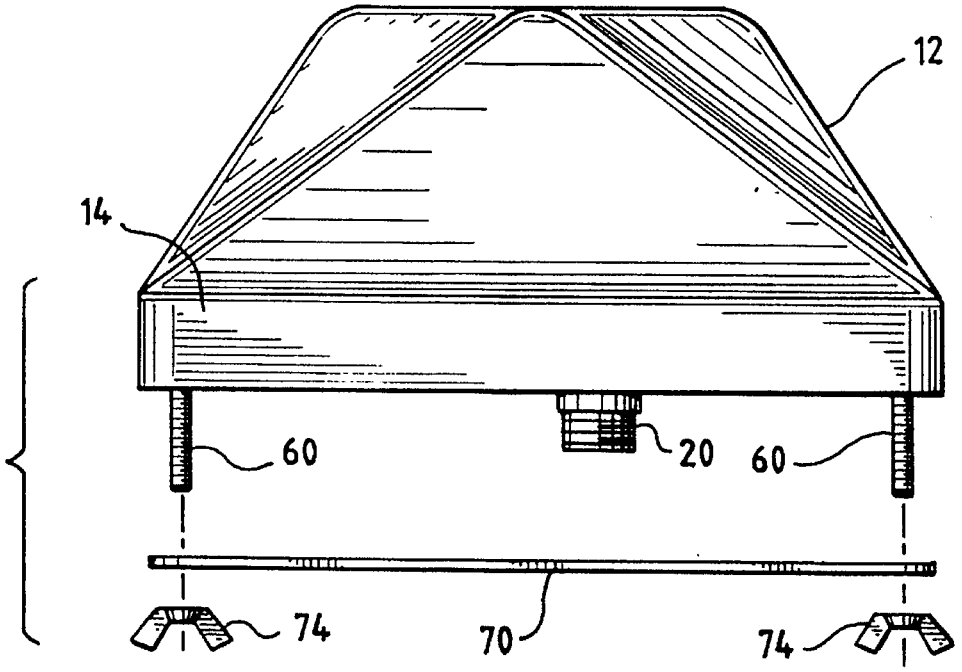
FIG. 2 is a partially exploded side elevational view of the antenna assembly of FIG. 1.

Referring now to the drawings, a radio frequency antenna assembly 10 for mounting on an internal ceiling or wall surface of a building is shown as being mounted on a tile C of a ceiling. Antenna assembly 10 comprises a decorative antenna housing having a radome or cover 12 with a selected geometric design terminating in a perimetric flange 14. The cover may desirably be formed of a plastic material, such as of ABS or PVC and may have a wall thickness of about 0.062". The bottom of the antenna assembly 10 is defined by a base plate 16, as of steel, brass or aluminum, to which internal elements comprising the receiving and transmitting antenna components may be mounted. The cover 12 and base plate 16 are suitably secured to each other, as adhesively, and together define an internal space or cavity of sufficient size to house the internal elements of the antenna A, including the radio frequency (RF) antenna elements themselves.

Figure 3:
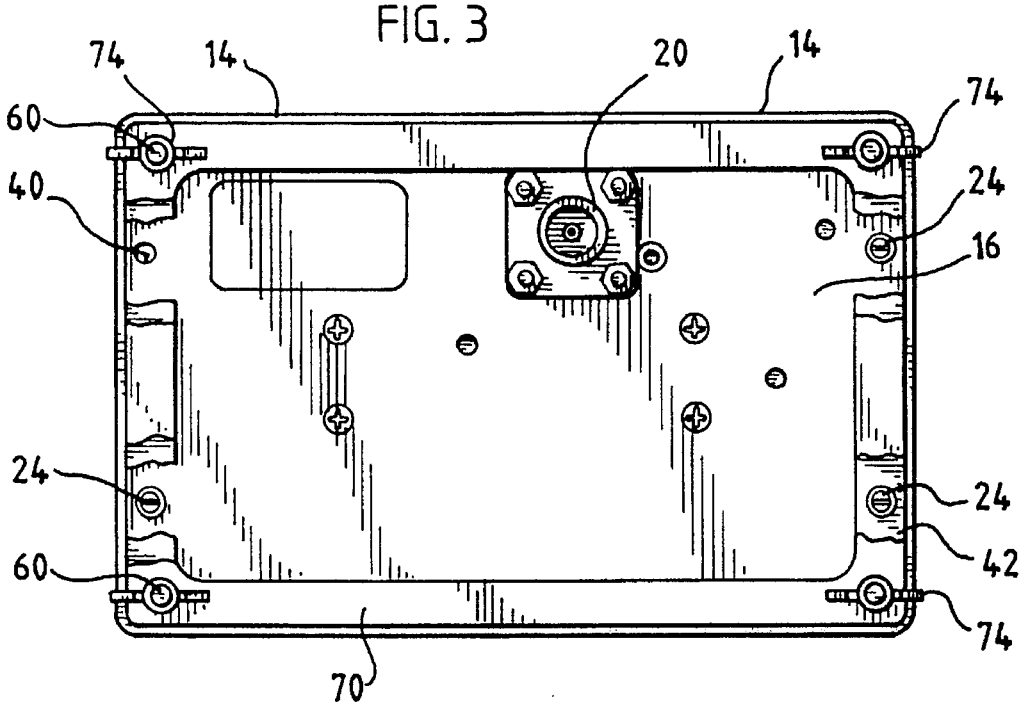
FIG. 3 is a bottom view of the antenna assembly of FIG. 1.
Figure 3A:
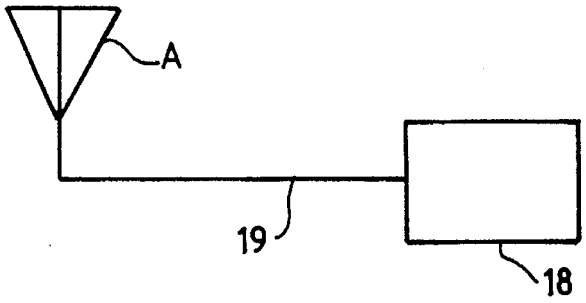
FIG. 3A is a schematic view of an antenna installation of the present invention.
Figure 4:
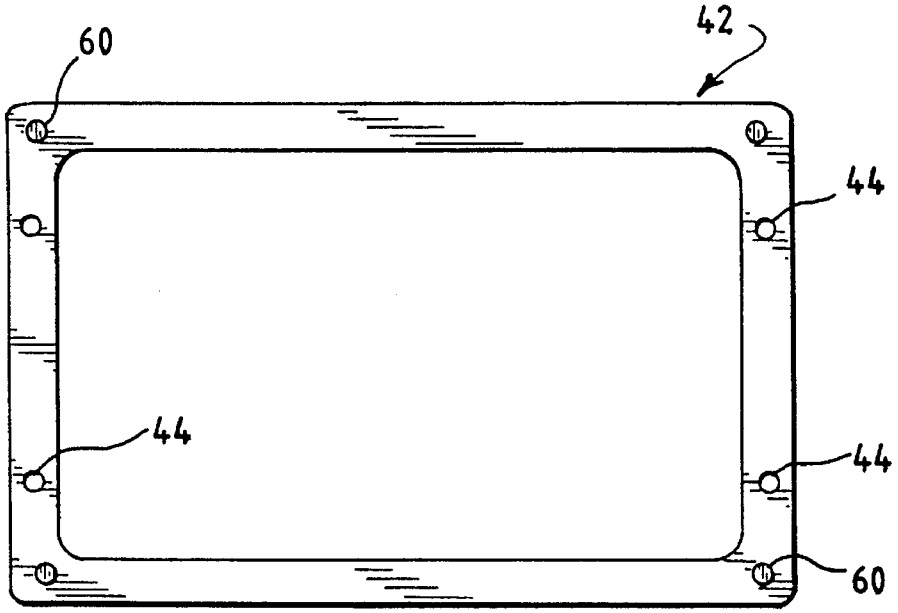
FIGS. 4 and 4A are bottom and side elevational views, respectively, of a first bracket of the antenna assembly of FIG. 1.
Figure 4A:
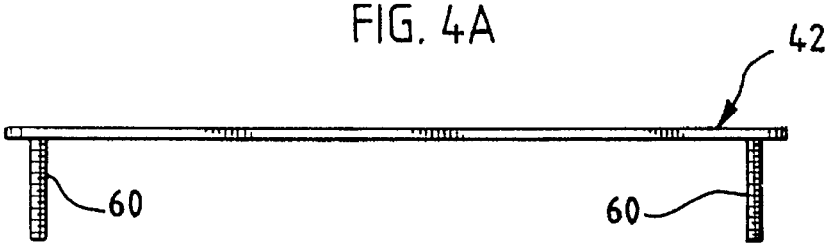
Figure 5:
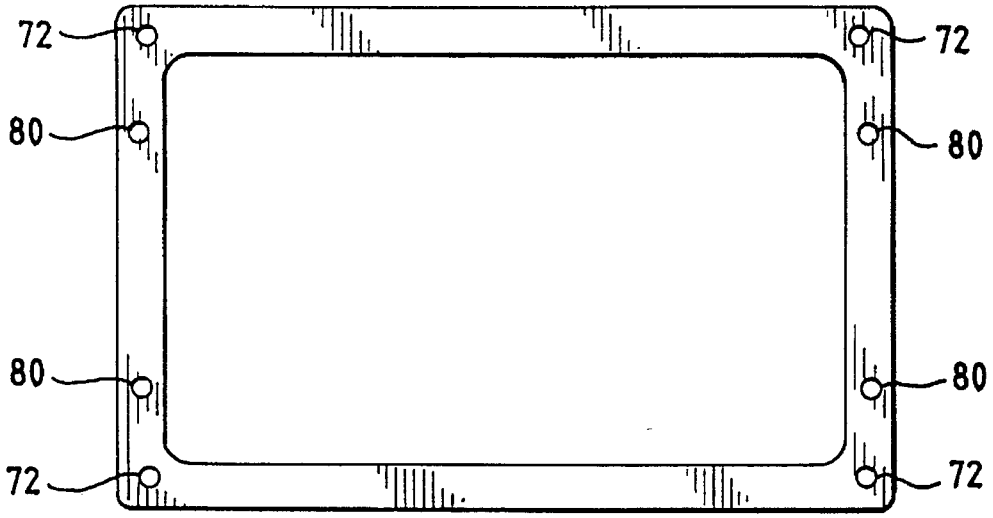
FIG. 5 is a bottom view of a second bracket of the antenna assembly of FIG. 1.

The antenna A itself is adapted to be electrically connected to an RF transceiver 18 by conventional cabling 19 (FIG. 3A) via a conventional coaxial connector 20 which is securely mounted to the base plate 16, as by a plurality of screws.

Figure 6:
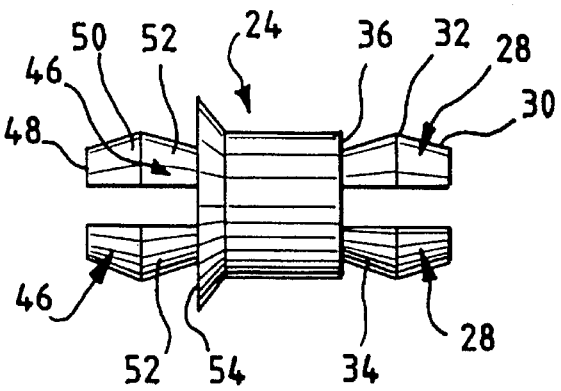
FIG. 6 is a side elevational view of a spacer pin as used in the assembly of FIG. 1.
Figure 7:
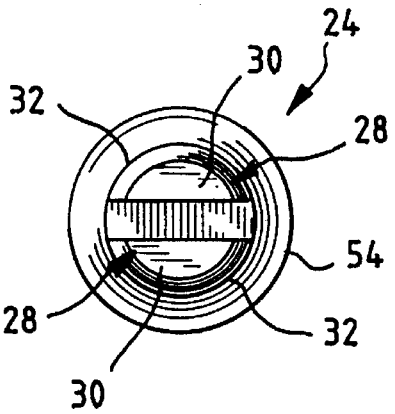
FIG. 7 is an end view of the spacer pin of FIG. 6.

To mount the antenna assembly 10 to a panel, such as via a ceiling tile C, a mounting assembly is provided. In its preferred form the mounting assembly employs a plurality of spacer pins 24 (FIGS. 6 and 7), each of which has integrally formed snap connectors or retainers at each of its pair of ends. At each end the snap connectors define a stop and at least a pair of spaced elements which are deformable to enter cooperating opening means, such as holes 40 in the housing base plate 16, and to be retained therein via the spaced elements.

The spaced elements 28 at one end of the pin which are to cooperate with holes 40 define an outer zone 30 which is of a size smaller than the size of the base plate holes 40, an intermediate zone 32 larger than the size of the base plate holes 40, and an inner zone 34 adjacent the stop 36, which inner zone has a size smaller than that of the intermediate zone. The outer zone 30 tapers from the outer end to the intermediate zone to facilitate camming of the spaced elements 28 toward each other, thereby to facilitate entry of the intermediate zone 32 into and through a hole 40. When that occurs, the spacer pin 24 is retained relative to the hole 40 between the intermediate zone 32 and the stop 36.

The antenna assembly also includes a first bracket 42. Bracket 42 defines a plurality of openings 44 which are aligned with pins 24. The openings 44 are undersized with respect to the spaced deformable pin segments 46, so that pin segments 46 may be deformed to enter a cooperating opening 44 in much the same manner that pin elements 28 entered plate holes 40. After they enter fully, they spring outwardly to retain bracket 42 in a fixed, spaced relationship to the base plate 16 and the overall antenna assembly 10.

It will be appreciated that the spaced segments 46, like spaced elements 28, have an outer zone 48 which is of a size less than the size of an opening 44, an intermediate zone 50 larger than the opening 44, and an inner zone 52 of a size less than that of the intermediate zone 50. The outer zone 48 tapers from the outer end to the intermediate zone 50 to facilitate camming of the spaced pin segments 46 towards each other, thereby to facilitate entry of the intermediate zone 50 into and through an associated opening 44. When that occurs, the pin 24 is retained relative to the opening 44, hence bracket 42, and has portions which straddle the bracket 42 between the stop 54 and the intermediate zone 50.

Thus it will be appreciated that both the spaced segments 46 and spaced elements 28 define outer dimensions at their outermost ends which are slightly less than the sizes or diameters of the holes and openings 40, 44, respectively, and that the intermediate zones 32, 50 are of sizes or diameters which are greater, respectively, than those of the holes and openings. Because the inner zones 34, 52 adjacent the stop elements 36, 54 are of sizes that are less than that of the intermediate zones, when the spacer pins and bracket 42 are thrust home relative to the plate and pins, respectively, the deformed spaced elements 28 and pin segments 46 expand outwardly and serve to reliably retain the antenna assembly in its desired assembled relationship with the base plate 16 and mounting bracket 42, respectively.

The bracket 42 also fixedly mounts a series of threaded studs 60. Studs 60 are of lengths sufficient to fully penetrate conventional ceiling tiles C (such as ¾ inch thick ceiling tiles) and to extend and project therethrough and thereby beyond. Desirably holes are bored through the ceiling tiles to receive the threaded studs, and the studs 60 are of sufficient lengths so that a second bracket 70 with holes 72 in line with the studs and in complementary locations may receive the studs 60. Wing nuts 74 may be used to draw the antenna assembly into secure engagement with the ceiling tile thereby to provide an aesthetically attractive, flushly mounted antenna assembly.

In one form, the pins may be of a plastic, such as Nylon, PVC, CPVC, Teflon, Kynar, Delrin or ABS, and may have a length, between stops 36, 54, of 0.25 inch. The brackets 42, 70 may be of stainless steel, or aluminum, 1/16 inch in thickness, with ⅜ inch webs. In one embodiment, the overall size of the antenna assembly is about 4 inches by 6 inches by about 2 inches high. The dimensions may vary and can produce a square or rectangular package or one which is of greater or lesser dimensions than the specific embodiment illustrated. The thickness of the base plate is also about 1/16 inch. The openings and holes are approximately 0.156" in diameter. The outer zone diameters are about 0.137" and the intermediate zone diameters are about 0.212. The stops are at least equal to the intermediate zone diameter and, therefore, serve therewith to retain engagement with the members defining the associated holes.

As an alternative to the use of threaded studs 60 for mounting the antenna assembly 10 to a wall or ceiling, a bracket, such as the bracket 70, with suitable openings 80 for receiving and retaining pin segments 48 may be instead employed. Thus, for a wall mount system, a bracket such as the bracket 70 may be secured to or at the surface of a wall and at a predetermined depth relative to the wall surface. Pins 24 of a length between stops corresponding to the distance of the base plate 16 from the bracket 70 when the two are assembled are selected. The pins 24 are then secured to plate 16 in the manner previously described. When the antenna assembly 10 is to be secured to the wall, the pins are juxtaposed with the openings 80 in bracket 70 and are forced home to snap into an interlocking relationship therewith, thereby to provide a finished flush mount for the antenna assembly.

Of course it will be apparent that the shapes of the inner portions of the spaced segments and pin segments will dictate the relative permanence of the connections with their associated elements and their relative ease of removal. Thus, if camming configurations as shown are used in the inner zones, separation of the pins from the associated openings and holes may proceed with relative ease. If the inner zone configurations on the inner sides of the intermediate zones are more vertical relative to the axis of the associated pin, the connection will tend to be more permanent.

The snap retaining configurations at the respective ends of the pins have been illustrated and described as fitting into generally circular openings and snapping or expanding thereinto to provide for retention of the base plate and bracket relative to each other. It will also be apparent that the pin segments at one or both ends may be configured to project into separate spaced openings in which they are retained against removal. They may spring inwardly (as shown) or outwardly relative to each other as they are forced into the associated openings, thereafter to spring back to their rest positions of retentive engagement with the member defining the associated openings.

It will also be apparent that the alternative mounting construction described may employ pins of greater lengths, such as lengths approximately that of the threaded studs. In such a case the lengths of the pin portion between the stops 36 and 54 may be extended. In that case, the pins 24 may be connected to the plate 16, as described, at one end, and may be snap connected via openings 80 in the second bracket 70 at their other ends (as in the manner described regarding the pin segments and the openings in bracket 42), thereby to obviate the need for the pair of brackets, the threaded fasteners and the wing nuts, all while providing an equivalent, alternative ceiling mounted antenna assembly.

Finally, it should also be clear that the wall or ceiling to which the antenna assembly is mounted should provide cable or conduit means for securance to the coaxial connector 20 which is provided on the antenna assembly 10. Desirably the connector 20 is on the plate 16 and is connected in a concealed fashion via the cable or conduit means.

From the foregoing it will be apparent to those skilled in the art that further modifications may be made without departing from the spirit and scope of the invention. Accordingly the invention is not to be considered as being limited by the embodiments described and illustrated, but only as may be made necessary in light of the appended claims.

What is claimed is:

1. An antenna assembly for flush mounting to a ceiling or wall surface of a building construction comprising an antenna housing comprising a cover and a base plate and an RF antenna housed within a cavity defined by said cover and said base plate, and a connector for connecting said antenna to a transceiver, said base plate defining a plate defining a plurality of openings, a bracket defining a plurality of openings, a plurality of pins, each having a pair of ends, each of said ends defining a plurality of spaced elements and a stop, one of said ends being disposed in a said base plate opening and the other of said ends being disposed in a said bracket opening, and wherein spaced elements at one end of each of said pins define a first outer zone smaller than the size of said base plate openings, a first intermediate zone larger than the size of said base plate openings, and a first inner zone smaller than said first intermediate zone, said stop being adjacent said first inner zone, and said stop and said first intermediate zone cooperating to retain said one end of the pin in said base plate opening in said inner zone, and wherein the spaced elements at the other ends of said pins define a second outer zone smaller than the size of said bracket openings, a second intermediate zone larger than the size of said bracket openings, and a second inner zone smaller than said intermediate zone, said stop being adjacent said second inner zone, and said stop and said second intermediate zone cooperating to retain said other end in said bracket opening in said second inner zone, whereby said antenna assembly may be securely and attractively flush mounted to an internal wall or ceiling of a building construction.

2. The antenna assembly of claim 1, and wherein said bracket mounts a plurality of threaded studs adapted to extend through a ceiling or wall surface panel, and means for securing said antenna assembly to a said panel.

3. The antenna assembly of claim 2, and wherein said means for securing said antenna assembly to a said panel comprises a second bracket defining holes in line with said threaded studs and receiving said studs, and a plurality of nuts for drawing said antenna assembly into secure, flush mounting engagement with said panel.

4. The antenna assembly of claim 1, and wherein the pin first and second inner zones define camming surfaces to facilitate removal of said pins and pin elements from their associated openings.

5. An antenna assembly for mounting on a ceiling or wall surface of a building construction comprising an antenna housing comprising a cover and a base plate, and an RF antenna housed within a cavity defined by said cover and said baseplate, and a connector for connecting said antenna to a transceiver, said base plate defining a plurality of openings, a bracket defining a plurality of openings, a plurality of pins, each having a pair of ends, each of said ends defining a plurality of snap retainers, engaging, at their respective ends, in said base plate openings and in said bracket openings, whereby when said bracket and base plate are fixed in relation to each other via said pins, said antenna assembly may be securely and attractively flush mounted to the internal wall or ceiling of a building construction, and wherein said bracket mounts a plurality of threaded studs adapted to extend through a ceiling or wall surface panel, and means for securing said antenna assembly to said panel, and wherein said means for securing said antenna assembly to said panel comprises a second bracket defining holes in line with said threaded studs and receiving said studs, and a plurality of nuts drawing said antenna assembly into secure, flush mounting engagement with said panel.

* * * * *